US008956191B2

(12) United States Patent
Oka et al.

(10) Patent No.: US 8,956,191 B2
(45) Date of Patent: Feb. 17, 2015

(54) CONNECTOR

(71) Applicant: Japan Aviation Electronics Industry, Limited, Tokyo (JP)

(72) Inventors: Toshihiro Oka, Tokyo (JP); Nobuhiro Ogawa, Tokyo (JP); Shigeyasu Kitamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 19 days.

(21) Appl. No.: 13/887,534

(22) Filed: May 6, 2013

(65) Prior Publication Data

US 2013/0303028 A1 Nov. 14, 2013

(30) Foreign Application Priority Data

May 10, 2012 (JP) ..... 2012-108201

(51) Int. Cl.
*H01R 12/70* (2011.01)
*H01R 12/72* (2011.01)
*H01R 13/41* (2006.01)

(52) U.S. Cl.
CPC ..... *H01R 12/70* (2013.01); *H01R 12/724* (2013.01); *H01R 13/41* (2013.01)
USPC ..... 439/626; 439/70; 439/72; 439/83; 439/876; 439/709; 439/721; 439/733.1

(58) Field of Classification Search
USPC ..... 439/70, 72, 83, 876, 709, 721, 733.1, 439/626
See application file for complete search history.

(56) References Cited

U.S. PATENT DOCUMENTS

| | | | | |
|---|---|---|---|---|
| 5,201,662 | A * | 4/1993 | Roche | 439/79 |
| 7,393,251 | B2 * | 7/2008 | Sakamaki et al. | 439/733.1 |
| 2006/0030184 | A1 | 2/2006 | Sasaki | |
| 2009/0176402 | A1 * | 7/2009 | Honda | 439/377 |
| 2010/0267256 | A1 | 10/2010 | Eriguchi et al. | |

FOREIGN PATENT DOCUMENTS

| | | | |
|---|---|---|---|
| JP | H04-132181 | A | 5/1992 |
| JP | H 05-190223 | A | 7/1993 |
| JP | H06-119946 | A | 4/1994 |
| JP | H10-154566 | A | 6/1998 |
| JP | 2000-077120 | | 3/2000 |
| JP | 2005-050745 | | 2/2005 |
| JP | 2006-049038 | A | 2/2006 |
| JP | 2007-103106 | | 4/2007 |

OTHER PUBLICATIONS

Japanese Office Action dated Jul. 4, 2013 in Japanese Application No. 2012-108201 with English translation.

* cited by examiner

*Primary Examiner* — James Harvey
*Assistant Examiner* — Matthew T Dzierzynski
(74) *Attorney, Agent, or Firm* — Collard & Roe, P.C.

(57) ABSTRACT

Provided is a connector comprising a plurality of rows of contacts and minimized in a front-rear direction. A first contact 30 positioned in an upper-row has a special shape constituted by a held portion 32 held by a housing 20, a connection portion 33 extending in a width direction from a rear end of the held portion 32, a first bent portion 35 extending from a front end of the connection portion 33 and being bent downward, and a first contact portion 36 extending downward from the first bent portion 35. A second contact 40 positioned in a lower-row has an L-shape. A second contact portion 44 of the second contact 40 is positioned obliquely rearward of the first contact portion 36 of the first contact 30.

5 Claims, 10 Drawing Sheets

CONNECTOR

CROSS REFERENCE TO RELATED APPLICATIONS

An applicant claims priority under 35 U.S.C. §119 of Japanese Patent Application No. JP2012-108201 filed May 10, 2012.

BACKGROUND OF THE INVENTION

This invention relates to a connector to be mounted on a circuit board, in particular to a connector having a plurality of rows of contacts.

A connector having a plurality of rows of contacts is disclosed in, for example, JP-A 2007-103106. An upper-row contact in the disclosed connector has an L-shape (an inverted L-shape). A lower-row contact has an upper-bent portion bent more than 90 degree angle and a lower-bent portion positioned lower than the upper-bent portion.

Another contact is disclosed in JP-A2005-50745. The disclosed contact has a specific shape so that a connector can resist high-voltage. In JP-A 2005-50745, a partition wall is provided between the contacts in order to increase a creepage distance.

The contacts of the lower-row in the connector of JP-A 2007-103106 are formed by complicated-bending process. Accordingly, a cost of manufacturing will be high. In addition, size of the connector in the front-rear direction will become large because of the upper-row of the contacts.

SUMMARY OF THE INVENTION

It is an object of the invention to provided a connector comprising a plurality of rows of contacts and minimized in a front-rear direction.

One aspect of the present invention provides a connector comprising: a housing; a plurality of first contacts, each of which comprises a first held portion held by the housing, a connection portion extending in the width direction from a rear end of the first held portion, a first bent portion extending from a front end of the connection portion and being bent downward, and a first contact portion extending downward from the first bent portion; and a plurality of second contacts, each of which comprises a second held portion held by the housing and positioned lower than the first held portion, a second bent portion extending from a rear end of the second held portion and bent downward, and a second contact portion extending downward from the second bent portion, the second contact portion being positioned obliquely rearward of the first contact portion.

An appreciation of the objectives of the present invention and a more complete understanding of its structure may be had by studying the following description of the preferred embodiment and by referring to the accompanying drawings.

Figure 1:
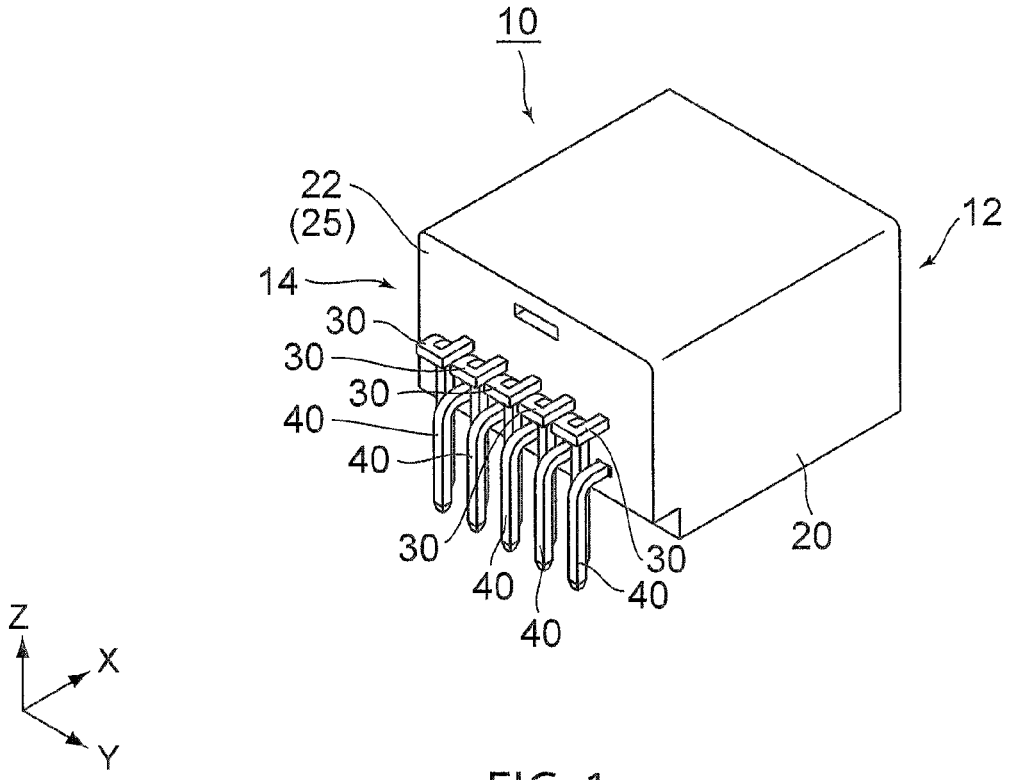
FIG. 1 is an oblique view showing a connector according to the first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS (First Embodiment)

With reference to FIG. 1 to FIG. 7, a connector 10 according to first embodiment of the present invention comprises a housing 20 made of insulation material, a first contact 30 made of conductive material, and a second contact 40 made of conductive material. The connector 10 of the embodiment has five first contacts 30 and five second contacts 40. The first contacts 30 constitute an upper contact-row, and the second contacts 40 constitute a lower contact-row.

Figure 2:
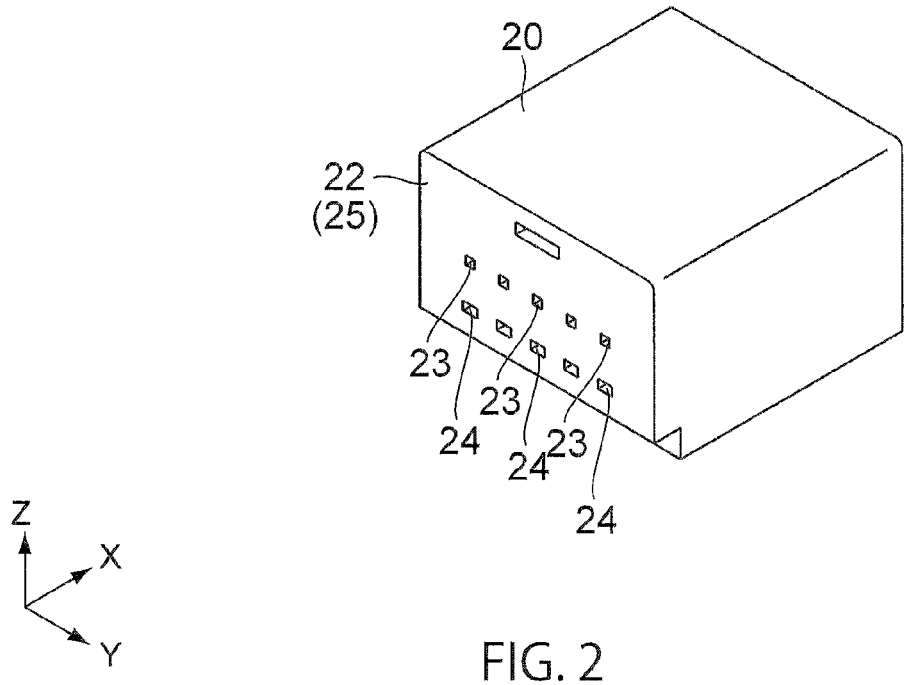
FIG. 2 is an oblique view showing a housing included in the connector of FIG. 1.
Figure 6:
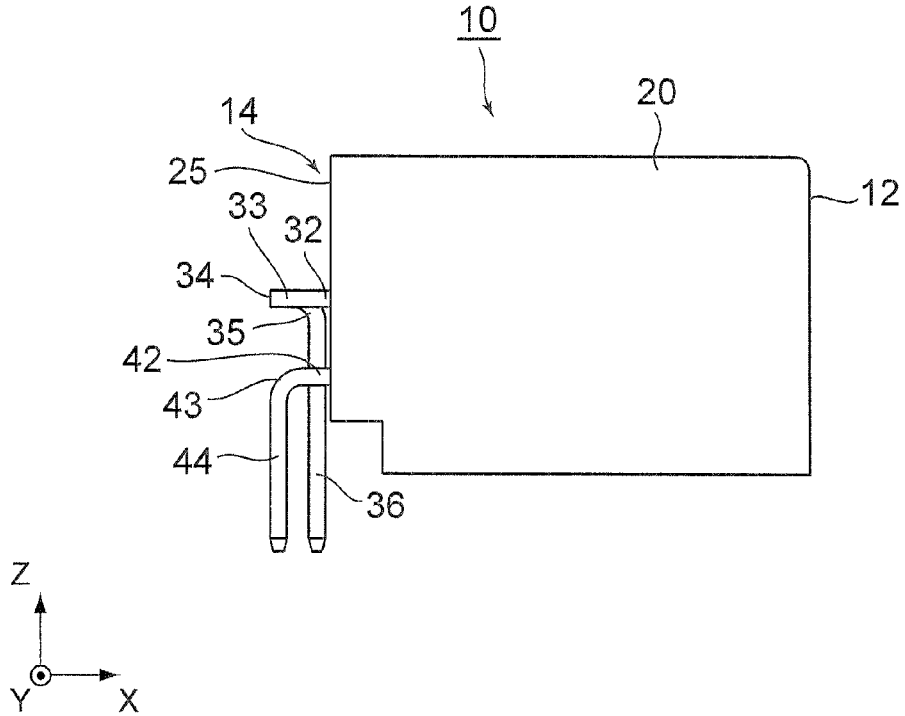
FIG. 6 is a side view showing the connector of FIG. 1.
Figure 7:
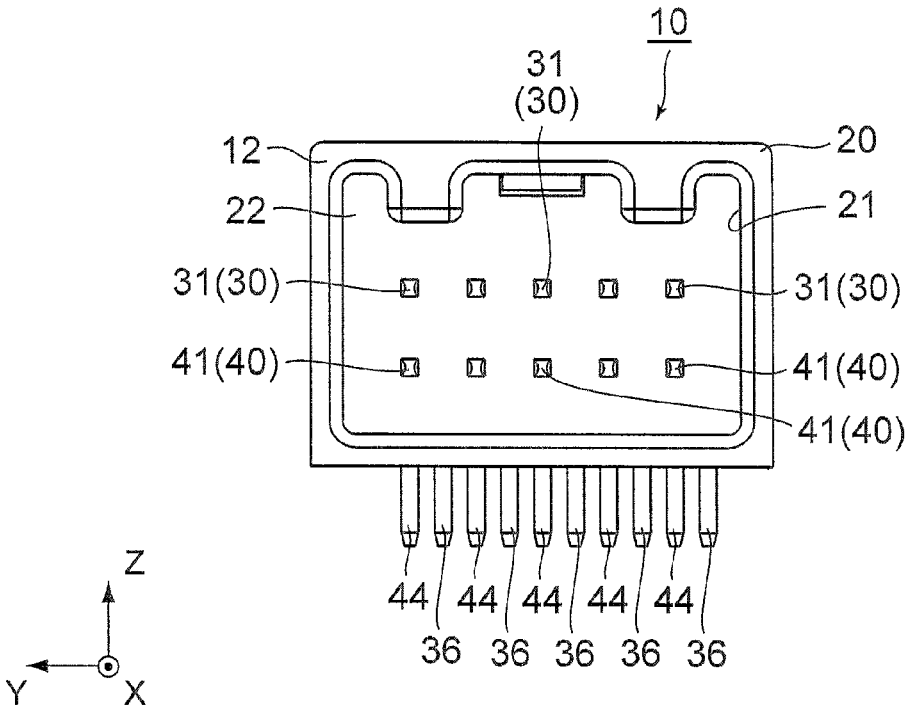
FIG. 7 is a front view showing the connector of FIG. 1.

As shown in FIG. 2, FIG. 6 and FIG. 7, the housing 20 has a receiving portion 21. The receiving portion 21 recessed backward (in −X direction) from a front end 12 of the connector 10. A rear end 14 of the connector 10 is a rear wall 22 of the housing 20. The rear wall 22 is formed with a plurality of through holes 23, 24. Outside of the rear wall 22 communicates with inside of the receiving portion 21 through the through holes 23, 24. In this embodiment, the through holes 23 correspond to the first contacts 30. Five through holes 23 are provided. The through holes 24 correspond to the second contacts 40. Five through holes 24 are provided. As shown in FIG. 2, the through holes 23 are arranged in line at regular intervals in a width direction (in a Y direction). Similarly, five through holes 24 are arranged in line at regular intervals in the width direction (in the Y direction). The through holes 23 are positioned upward (in a +Z direction) of the through holes 24. The through holes 23 and the through holes 24 are also arranged in line in an up-down direction (in a Z direction).

Figure 3:
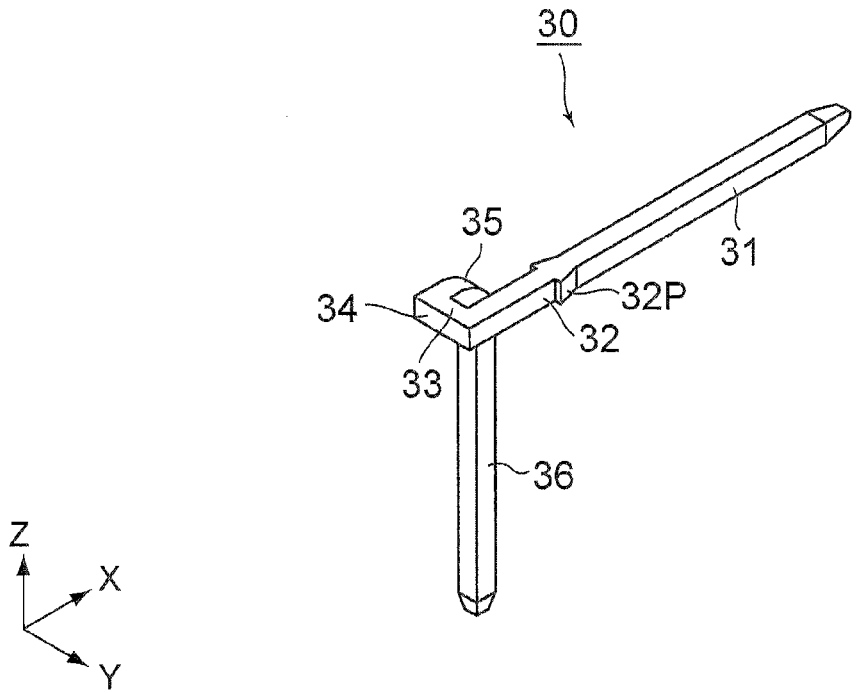
FIG. 3 is an oblique view showing a first contact included in the connector of FIG. 1
Figure 8:
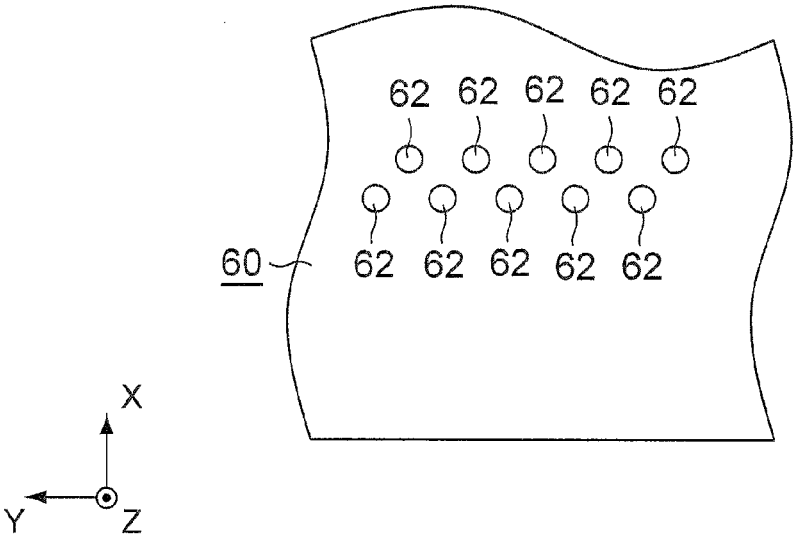
FIG. 8 is a top view showing a circuit board on which the connector of FIG. 1 is mounted.

As shown in FIG. 3, the first contact 30 comprises a first pin portion 31, a first held portion 32, a connection portion 33, a first bent portion 35 and a first contact portion 36. The first pin portion 31 extends forward (in the +X direction) inside the receiving portion 21. The first pin portion 31 is brought into contact with a mating contact (not shown) when the connector 10 is connected with a mating connector (not shown). The first held portion 32 is inserted into the through hole 23 and held by the housing 20. The first held portion 32 has press-fit portions 32P protruding in the width direction. In this embodiment, a boundary between the first pin portion 31 and the first held portion 32 is not clearly defined. The connection portion 33 extends from a rear end (an end in the −X direction) of the first held portion 32 in the width direction (in the −Y direction). A rear end surface 34 of the connection portion 33 has a rectangular shape so that the rear end surface 34 is easy to be pushed forward. The first contact 30 is inserted into the through hole 23, easily and with stability, by pushing the rear end surface 34 with jig or the like. The first bent portion 35 extends from a front end (an end in the +X direction) of the connection portion 33 and is bent downward (in the −Z direction). The first contact portion 36 is inserted into and soldered to a hole (described later: reference numeral 62 in FIG. 8) when the connector 10 is mounted and fixed to the circuit board (described later: reference numeral 60 in FIG. 8). In other words, the first contact portion 36 is a DIP portion. The first contact portion 36 extends downward (in the −Z direction) from a lower end (an end in the −Z direction) of the first bent portion 35.

Figure 9:
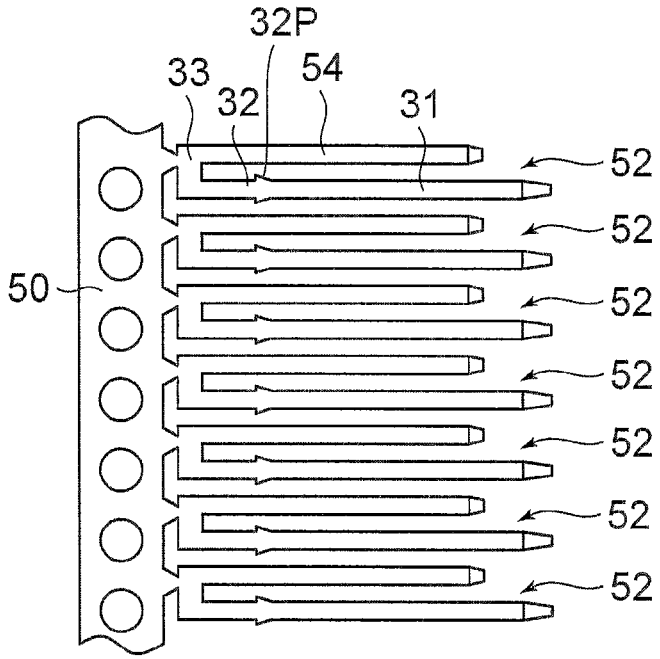
FIG. 9 is a top view showing a blank member of the first contact of FIG. 3.

The above-described first contact 30 is obtained by processing a blank member 52 shown in FIG. 9. The blank member 52 is formed by punching (pressing) a metal sheet. A plurality of the blank members 52 are connected with a carrier 50. Each of the blank members 52 has a rectangular U-shape. In detail, the blank member 52 has the first pin portion 31, the first held portion 32, the connection portion 33 and a processed portion 54 extending from the connection portion 33. The processed portion 54 and the first held portion 32 extend in the same direction. In other words, the processed portion 54 extends in parallel with the first held portion 32 and the first pin portion 31. The processed portion 54 corresponds to the first bent portion 35 and the first contact portion 36. A bending-process is carried out for the processed portion 54 so that the first bent portion 35 is formed and the first contact portion 36 is directed downward.

As understood from FIG. 9, the blank member 52 of the first contact 30 can eliminate waste of material (a metal sheet). In other words, the structure of the blank member 52 can archive an effective use of material. Accordingly, a large number of first contacts 30 can be obtained from one metal sheet. Moreover, the carrier 50 is coupled with the connection portions 33. In other words, a portion corresponding to the first bent portions 35 is positioned in the vicinity of the carrier 50. The processed portion 54 is bent into 90 degree with reference to the surface of the carrier 50. Generally, when the carrier 50 is close to the bent point (i.e. the portion corresponds to the first bent portion 35), the bending process can be carried out accurately. In this embodiment, the carrier 50 is closer to the portion corresponds to the first bent portion 35 so that the first contact portion 36 can be bent downward accurately. Therefore, when the first contacts 30 are held by the housing 20, the first contact portions 36 are arranged accurately.

Figure 4:
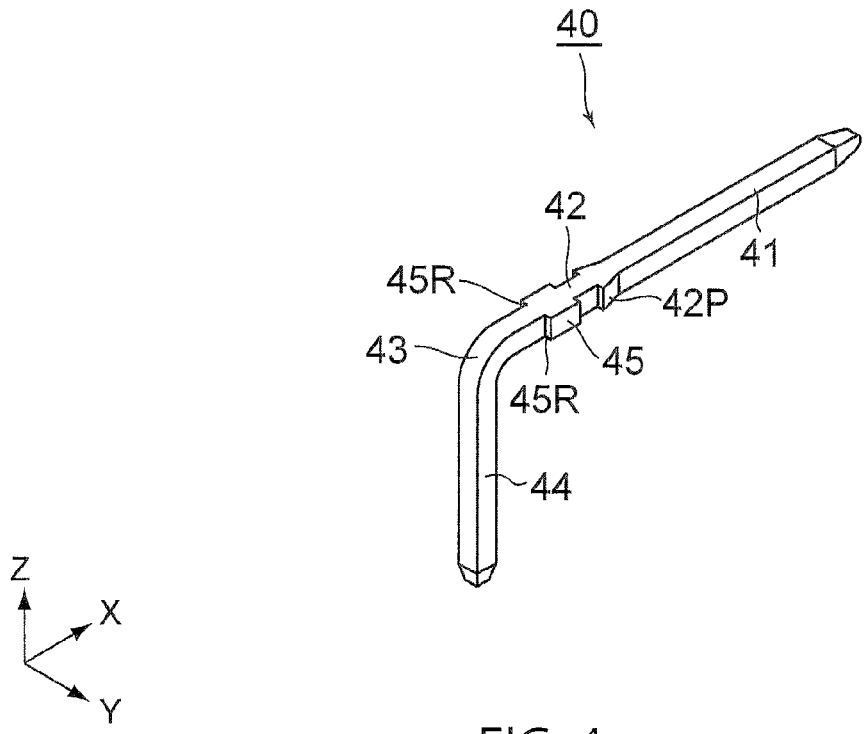
FIG. 4 is an oblique view showing a second contact included in the connector of FIG. 1

As shown in FIG. 4, the second contact 40 has an L-shape. The second contact 40 comprises a second pin portion 41, a second held portion 42, a second bent portion 43 and a second contact portion 44. The second pin portion 41 extends forward (in the +X direction) in the receiving portion 21. The second pin portion 41 is brought into contact with a mating contact (not shown) when the connector 10 is connected with a mating connector (not shown). The second held portion 42 is inserted into the through hole 24 positioned lower than the through hole 23 and held by the housing 20. In other words, the second held portions 42 are positioned lower than the first held portion 32 when the second held portion 42 are held by the housing 20. The second held portion 42 has press-fit portions 42P protruding in the width direction. Moreover, the second held portion 42 has a rectangular portion 45 protruding in the width direction. Similar to the rear end surface 34 of the first contact 30, the rear end surfaces 45R of the rectangular portion 45 are easy to be pushed forward. Thus, the second contact 40 is, easily and with stability, inserted into the through hole 24 by pushing the rear end surfaces 45R with jig or the like. The second bent portion 43 is bent downward (in the −Z direction) from the rear end (an end in the −X direction) of the second held portion 42. The second contact portion 44 is inserted into and soldered to a hole (described later: reference numeral 62 in FIG. 8) when the connector 10 is mounted and fixed to the circuit board (described later: reference numeral 60 in FIG. 8). In other words, the second contact portion 44 is a DIP portion. The second contact portion 44 extends downward (in the −Z direction) from a lower end (an end in the −Z direction) of the second bent portion 43. As described above, the press-fit portion 42P and the rectangular portion 45 are provided to the second contact 40 separately. However, the press-fit portion 42P and the rectangular portion 45 may be formed integrally with each other.

Figure 5:
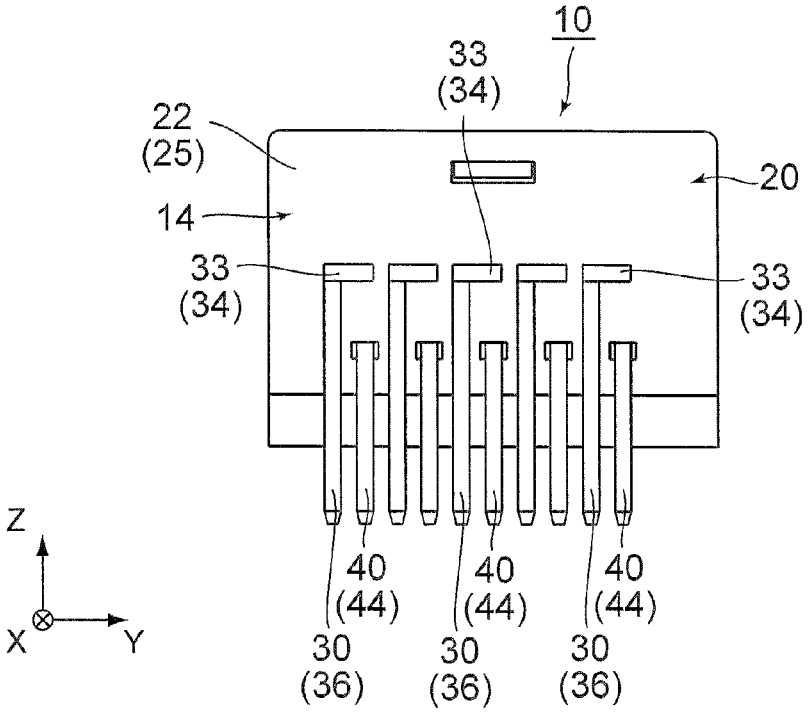
FIG. 5 is a rear view showing the connector of FIG. 1.

As understood from FIG. 5 and FIG. 7, the first contact portion 36 of the first contact 30 and the second contact portion 44 of the second contact 40 are alternately lined when seen along the front-rear direction (along the X direction). In other words, as understood from also FIG. 8, the first contact portion 36 of the first contact 30 and the second contact portion 44 of the second contact 40 are differ in position in the width direction (in the Y direction) and do not overlap each other when seen along the front-rear direction (the X direction).

As understood from FIG. 6, when seen along the width direction (along the Y direction), the first contact portion 36 of the first contact 30 and the second contact portion 44 of the second contact 40 are also differ in position in front-rear direction (in the X direction). In detail, the first contact portion 36 of the first contact 30 is positioned forward (in the +X direction) of the second contact portion 44 of the second contact 40. In this embodiment, both the first contact portion 36 of the first contact 30 and the second contact portion 44 of the second contact 40 are positioned rearward (in the −X direction) of the rear surface 25 of the housing 20.

As understood from the above-explanation, the first contact portion 36 of the first contact 30 and the second contact portion 44 of the second contact 40 are arranged in a staggered configuration.

The first contact portion 36 of the first contact 30 is positioned forward (in the +X direction) of the second contact portion 44 of the second contact 40. Thus, a footprint of the connector 10 on the circuit board (described later: reference numeral 60 in FIG. 8) is determined by width of the connector 10 (width of the housing 20) and length between the front end 12 of the connector 10 (a front end of the housing 20) and the second contact portion 44 of the second contact 40. As compared with the conventional technique, the connector 10 of the present invention can minimize the footprint.

The first contact portion 36 of the first contact 30 and the second contact portion 44 of the second contact 40 are arranged in the staggered configuration so that distance between neighboring holes 62 used for the first contact portion 36 and the second contact portion 44 can be increased. Accordingly, the circuit board 60 is easily manufactured.

(Second Embodiment)

With reference to FIG. 10 to FIG. 16, the connector 10A according to the second embodiment of the present invention comprises a housing 20A made of insulation material, first contacts 30R, 30L made of conductive material and second contacts 40 made of conductive material. Hereafter, the same numerals are given to the components similar to the above-described connector 10 of the first embodiment and, therefore, the description of those components will be simplified.

The connector 10A of the embodiment is used for the differential-signal transmission. Specifically, the second contacts 40 are used for the differential-signal, the first contacts 30R, 30L are used for power. However, the connector 10A may be used for various purposes.

Figure 11:
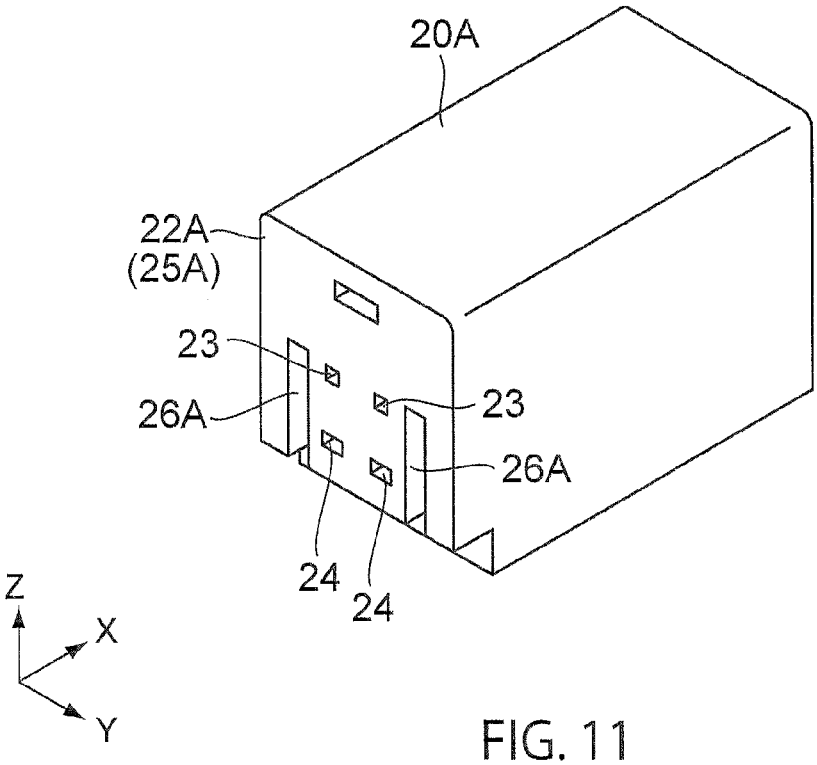
FIG. 11 is an oblique view showing a housing included in the connector of FIG. 10.
Figure 15:
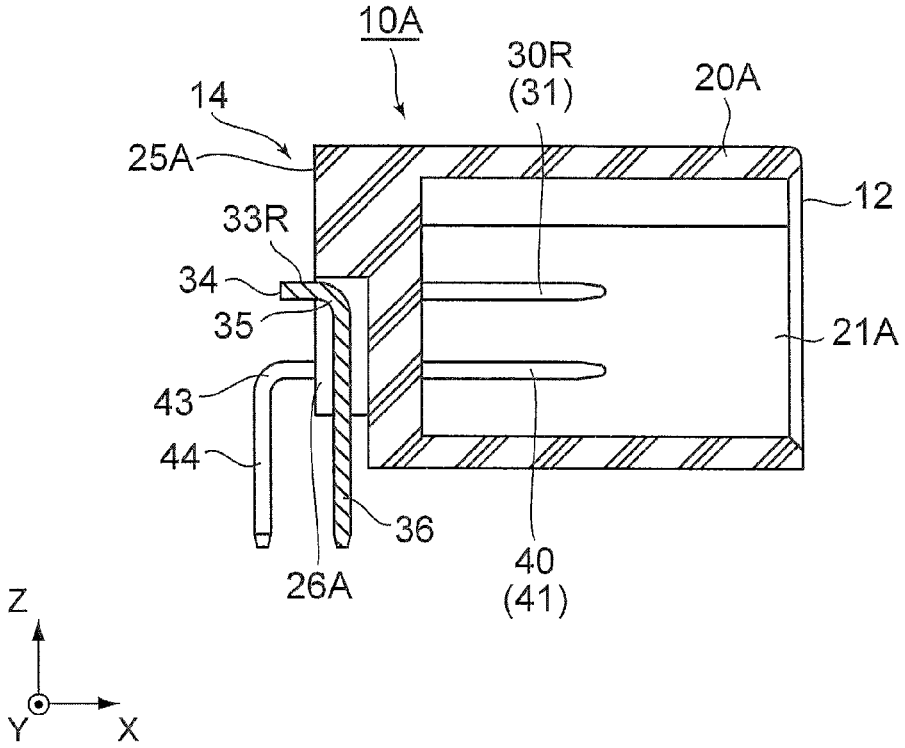
FIG. 15 is a cross-sectional side view showing the connector of FIG. 14, taking along line XV--XV.
Figure 16:
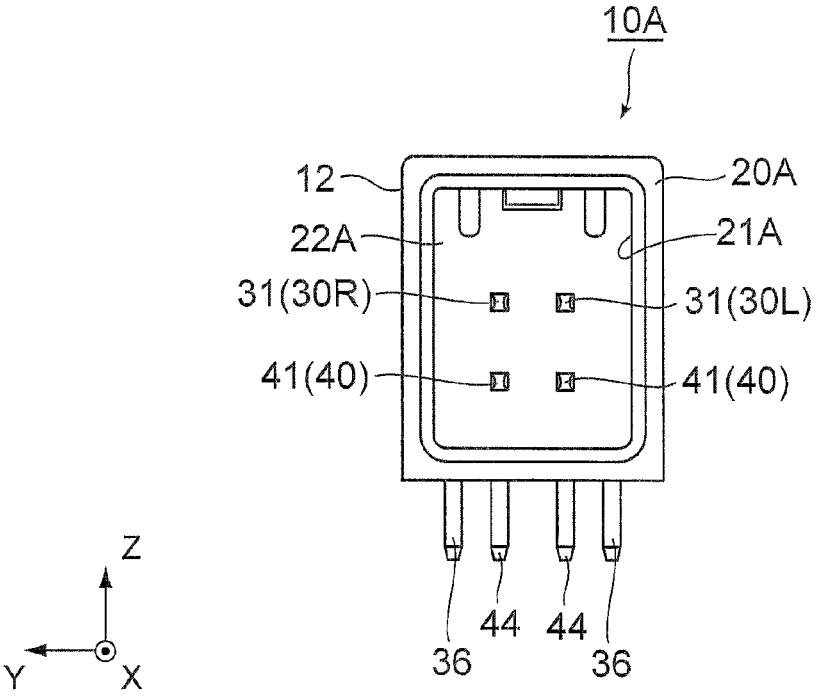
FIG. 16 is a front view showing the connector of FIG. 10.

As shown in FIG. 11, FIG. 15 and FIG. 16, the housing 20A has a receiving portion 21A. The receiving portion 21A is recessed rearward (in the −X direction) from the front end 12 of the connector 10A. A rear wall 22A of the housing 20A is formed with the through holes 23, 24. In this embodiment, the through holes 23 correspond to the first contacts 30R, 30L, two of the through holes 23 are formed. The through holes 24 correspond to the second contacts 40, two of the through holes 24 are formed. As shown in FIG. 11, the through holes 23 and the through holes 24 are arranged in line in the up-down direction (in the Z direction).

As shown in FIG. 11 and FIG. 15, the housing 20A of the embodiment has slits 26A. The slits 26A are formed on the rear wall 22A. The slits 26A are recessed forward (in the +X direction) from a rear surface 25A and extend downward (in the −Z direction).

Figure 12:
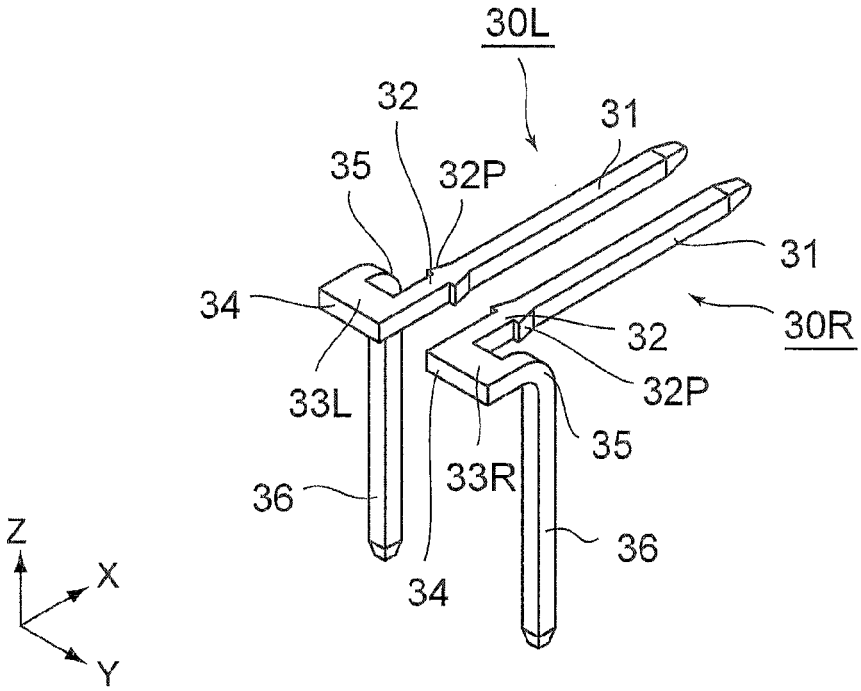
FIG. 12 is an oblique view showing a pair of first contacts included in the connector of FIG. 10.

As shown in FIG. 12, each of the first contacts 30R, 30L comprises the first pin portion 31, the first held portion 32, the connection portions 33R, 33L, the first bent portion 35 and the first contact portion 36. The first pin portion 31, the first held portion 32, the first bent portion 35 and the first contact portion 36 are similar to the corresponding components explained in the first embodiment. Similarly to the first embodiment, the connection portions 33R, 33L, extend from the rear ends (the end in the −X direction) of the first held portions 32 in the width direction (in the Y direction). However, an extending direction of the connection portion 33R is opposite to another extending direction of connection portion 33L. In other words, as shown in FIG. 12, the connection portion 33R extends in the direction opposite to the direction of the first contacts 30L in the width direction (in the Y direction). Accordingly, the first contacts 30R, 30L are symmetric about a vertical surface (an XZ surface) passing through the middle part of the first contacts 30R, 30L in the width direction (in the Y direction).

Figure 10:
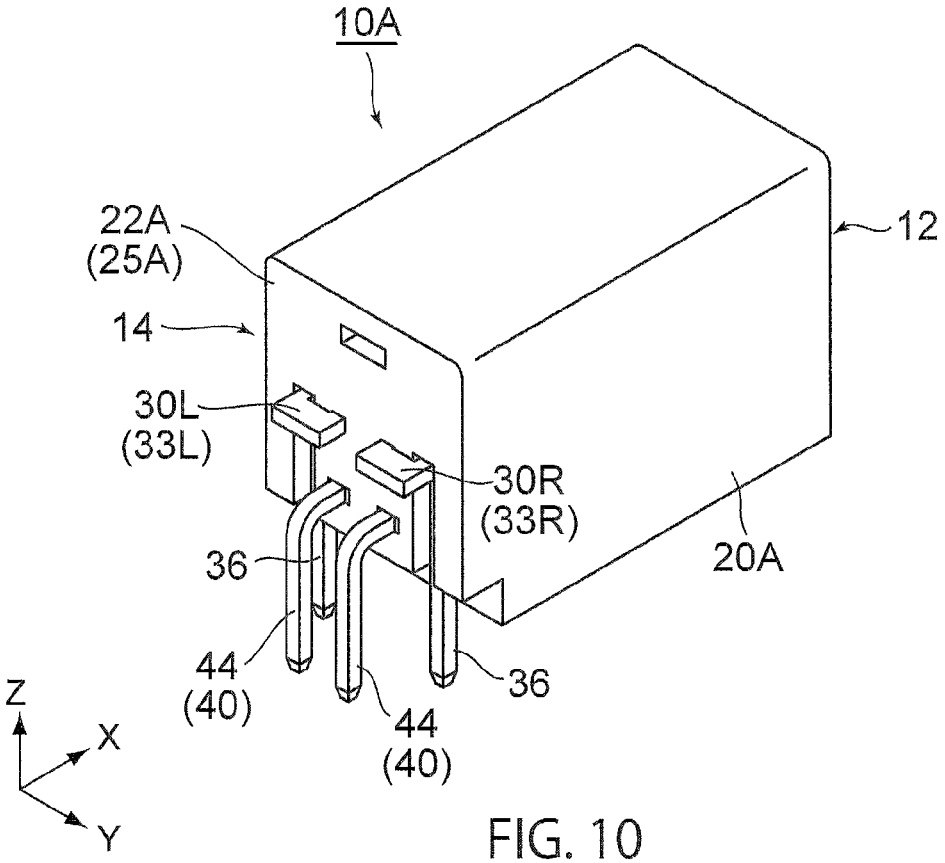
FIG. 10 is an oblique view showing a connector according to the second embodiment of the present invention.
Figure 14:
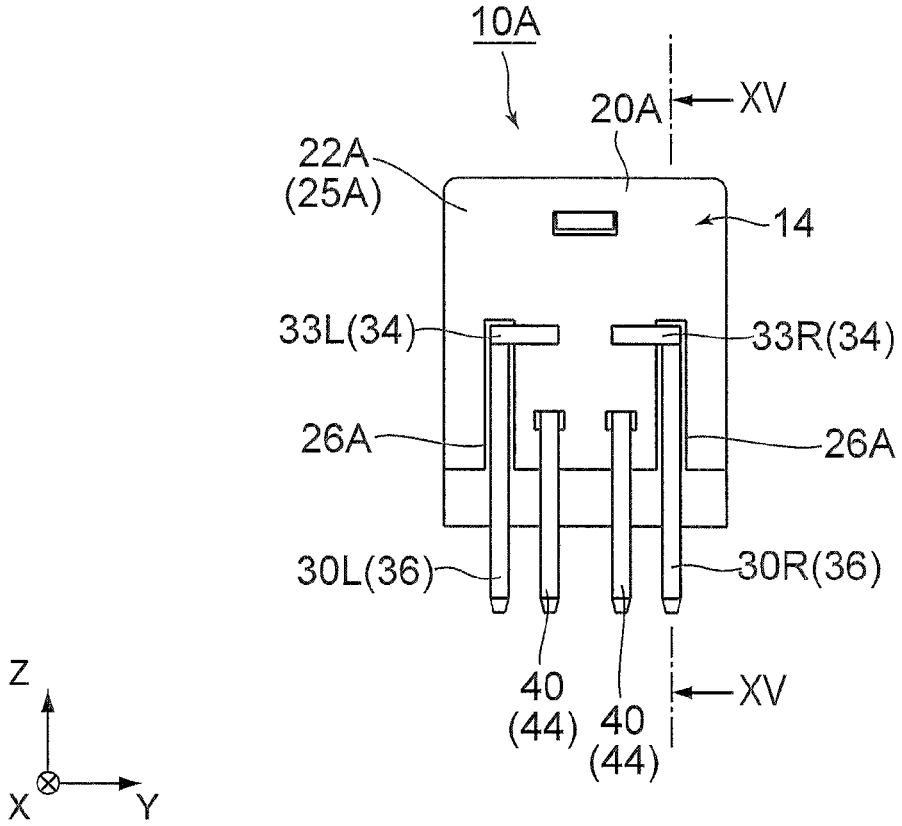
FIG. 14 is a rear view showing the connector of FIG. 10.

As shown in FIG. 10, FIG. 14 and FIG. 15, the first contact portions 36 of the first contacts 30R, 30L extend downward (in the −Z direction) of the housing 20A through the slit 26A. As best shown in FIG. 15, the first contact portion 36 of the embodiment is positioned forward (in the +X direction) of the rear surface 25A of the housing 20A.

In this embodiment, the width of the slit 26A (the size in the Y direction) corresponds to the width of each of the first contact portions 36 of the first contacts 30R, 30L. Therefore, the slit 26A serves as a locator which arranges the first contact portions 36 of the first contacts 30R, 30L.

Figure 13:
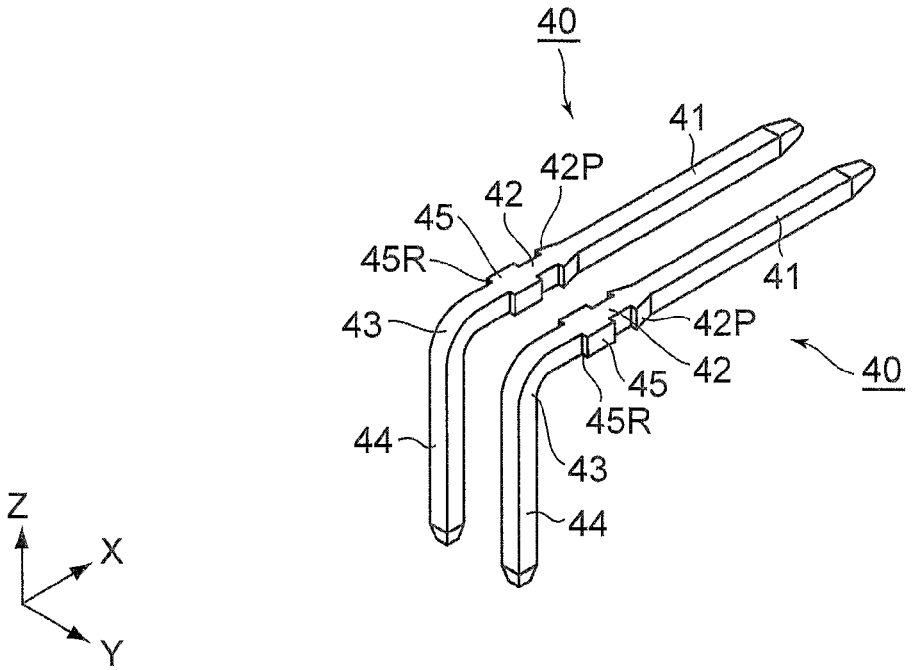
FIG. 13 is an oblique view showing a pair of second contacts included in the connector of FIG. 10.

As shown in FIG. 13, the second contact 40 has a shape same as the second contact 40 of the first embodiment. The second contacts 40 are held by the housing 20A as shown in FIG. 10 and FIG. 15. The second contact portions 44 of the second contacts 40 are positioned rearward (in the −X direction) of the rear surface 25A of the housing 20A.

As best shown in FIG. 15, when seen along the width direction (in the Y direction) of the connector 10A, the first contact portion 36 of the first contact 30R (first contact 30L) and the second contact portion 44 of the second contact 40 are differ in position in the front-rear direction (in the X direction). In detail, the first contact portion 36 of the first contact 30R (first contact 30L) is positioned forward (in the +X direction) of the second contact portion 44 of the second contact 40.

As understood from FIG. 14 and FIG. 16, when seen from the connector 10A in the front-rear direction (in the X direction), the second contact portions 44 of the second contacts 40 are positioned between the first contact portions 36 of the first contacts 30R, 30L in the width direction (in the Y direction). In other words, the first contact portions 36 of the first contacts 30R, 30L and the second contact portions 44 of the second contact 40 are differ in position in the width direction (in the Y direction) and do not overlap each other when seen along the front-rear direction (the X direction).

Specifically, the first contact portion 36 of the first contact 30R, two second contact portions 44 of the second contacts 40 and the first contact portion 36 of the first contact 30 are arranged in this order in the width direction (in the Y direction). In other words, the second contact portions 44 of the second contacts 40 for the differential signal are adjacent to each other. The first contact portions 36 of the first contacts 30R, 30L for the power are positioned outside of the second contact portions 44. Therefore, two conductive lead paths for the second contact portions 44 (i.e. for differential signals) on the circuit board 60 can be routed rearward side by side so that lengths of the conductive lead paths can be maintained to be same with each other. Thus, according to the embodiment, transmission of the differential signals can be improved, and a conductive pattern can be easily designed.

(Third Embodiment)

Figure 17:
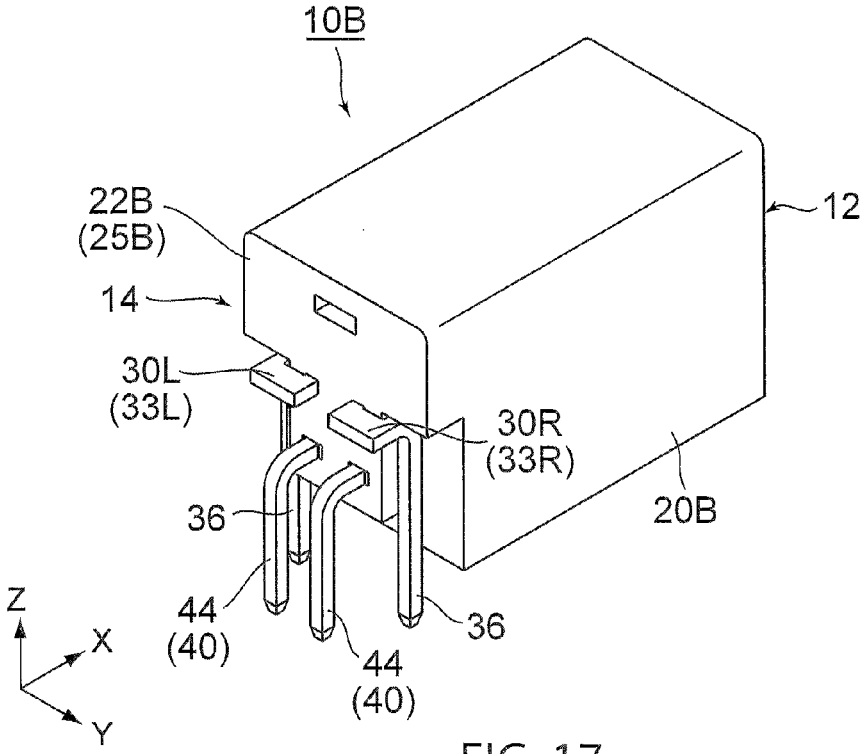
FIG. 17 is an oblique view showing a connector according to third embodiment of the present invention.
Figure 18:
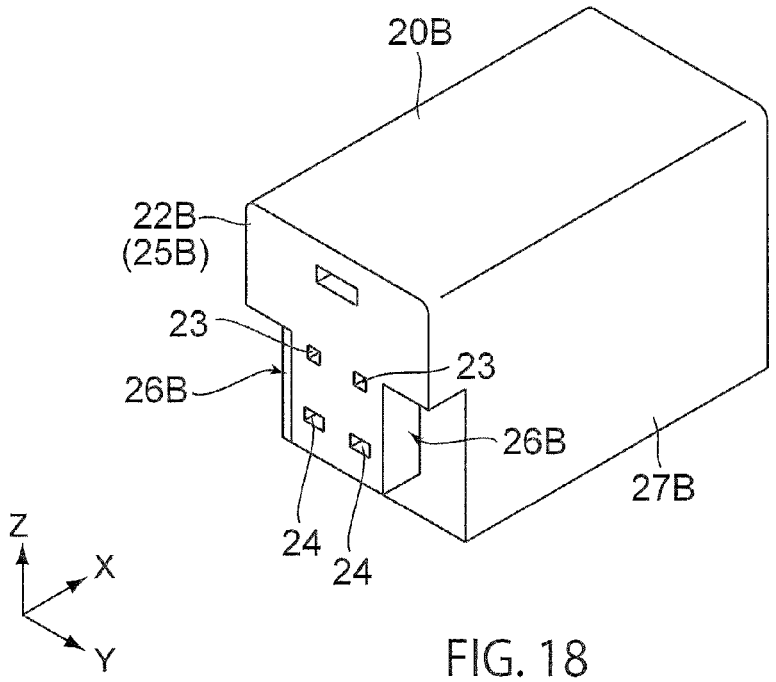
FIG. 18 is an oblique view showing a housing included in the connector of FIG. 17.
Figure 19:
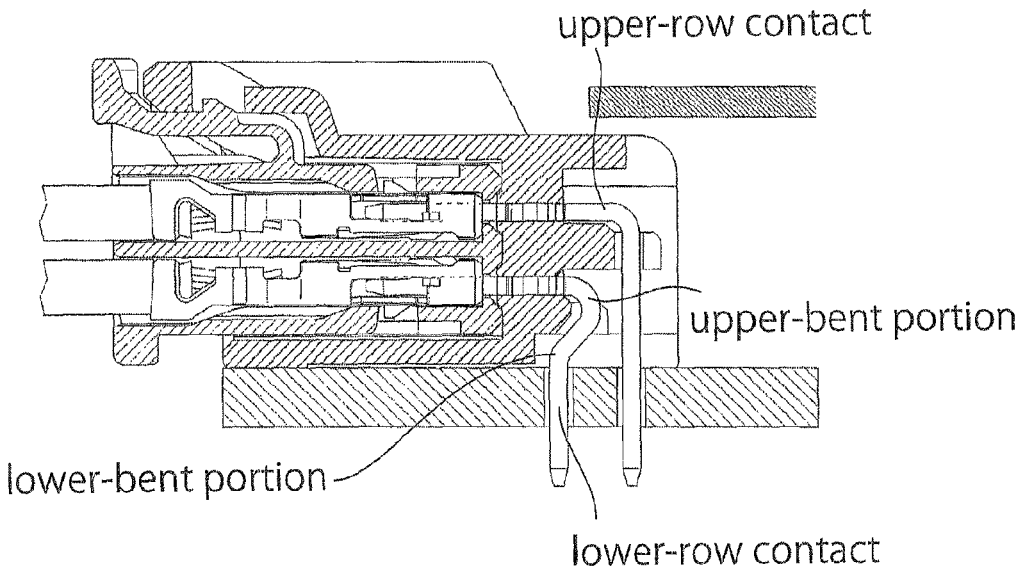
(PRIOR ART) FIG. 19
FIG. 19 is a cross-sectional view showing the connector of JP-A 2007-103106.
Figure 20:
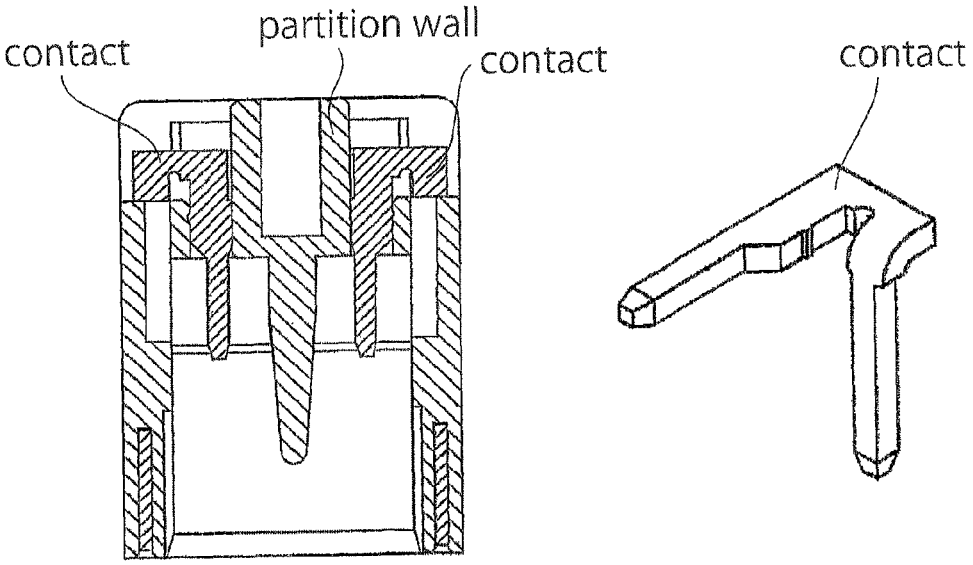
(PRIOR ART) FIG. 20
FIG. 20 is a cross-sectional view showing the connector of JP-A 2005-50745 (left figure), and an oblique view showing a contact included in the connector (right figure).

With reference to FIG. 17 and FIG. 18, the connector 10B according to the third embodiment of the present invention is a variation example of the connector 10A of the second embodiment. Hereafter, only the components different from the connector 10A of the second embodiment will be explained.

A housing 20B of a connector 10B has recessed portions 26B instead of the slits 26A (see FIG. 11). The recessed portions 26B has a shape formed by enlarging the slit 26A outward in the width direction. In other words, the recessed portions 26B recessed forward (in the +X direction) of the rear surface 25B and inward from the side surface 27B in the width direction (in the Y direction).

The first contact portions 36 extend downward (in the −Z direction) of the housing 20B through the corresponding recessed portions 26B. The first contact portions 36 positioned in the recessed portions 26B are visible in the width direction (in the Y direction).

The explanation of the present invention was made above, however, the connector of the present invention may be, for example, covered with a metal shell.

Each of the connectors 10, 10A, 10B has two rows of contacts (i.e. the first contacts 30, 30L, 30R and the second contacts 40), however, the connectors 10, 10A, 10B may further have another contacts. In other words, the connectors 10, 10A, 10B may have more than three rows of contacts as long as the connectors 10, 10A, 10B have the first contacts 30, 30L, 30R and the second contacts 40.

In addition, the above-described connectors 10, 10A, 10B are the so-called DIP type wherein the first contact portions 36 and the second contact portions 44 are inserted into the holes 62 on the circuit board 60 and soldered, however, the connector of the present invention may be an SMT type wherein the first contact portions 36 and the second contact portions 44 are connected with conductive patterns on the circuit board.

The present application is based on a Japanese patent application of JP2012-108201 filed before the Japan Patent Office on May 10, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a housing;

a plurality of first contacts, each of which comprises a first held portion held by the housing, a connection portion extending in the width direction from a rear end of the first held portion, a first bent portion extending from a front end of the connection portion and being bent downward, and a first contact portion extending downward from the first bent portion;

a plurality of second contacts, each of which comprises a second held portion held by the housing and positioned lower than the first held portion, a second bent portion extending from a rear end of the second held portion and bent downward, and a second contact portion extending downward from the second bent portion, the second contact portion being positioned obliquely rearward of the first contact portion; and wherein the housing has a rear surface, the first contact portion being positioned forward of the rear surface, the second contact portion being positioned rearward of the rear surface.

2. The connector as recited in claim 1, wherein:

the connector comprises two of the first contacts and two of the secondcontacts;

each of the connection portions of the first contacts extends outward of the rear end of the first held portion; and the first contact portions are positioned outside of two of the second contact portions in the width direction.

3. The connector as recited in claim 1, wherein:

the first contact is obtained by processing a blank member having an angular U-shape;

the blank member has the first held portion, the connection portion, and a processed portion extending in parallel with the first held portion from the front end of the connection portion; and a bending-process is carried out for the processed portion so that the first bent portion is formed and the first contact portion is directed downward.

4. The connector as recited in claim 1, wherein the housing has a slit formed on the rear surface, the slit being recessed forward and extending downward, the first contact portion extending downward of the housing through the slit.

5. The connector as recited in claim 1, wherein the housing further has a side surface and a recessed portion, the recessed portion being recessed inward of the side surface and forward of the rear surface and, the first contact portion extending downward of the housing through the recessed portion, the first contact portion positioned in the recessed portion being visible in the width direction.

* * * * *

UNITED STATES PATENT AND TRADEMARK OFFICE

CERTIFICATE OF CORRECTION

PATENT NO. : 8,956,191 B2
APPLICATION NO. : 13/887534
DATED : February 17, 2015
INVENTOR(S) : Oka et al.

It is certified that error appears in the above-identified patent and that said Letters Patent is hereby corrected as shown below:

In the Claims

In particular, in Column 8, Line 9 (Line 3 in Claim 2), please change "secondcontacts" to correctly read: --second contacts--.

Signed and Sealed this
Sixteenth Day of June, 2015

Michelle K. Lee

Michelle K. Lee
*Director of the United States Patent and Trademark Office*